US007721728B2

(12) United States Patent
Ho Kim et al.

(10) Patent No.: US 7,721,728 B2
(45) Date of Patent: May 25, 2010

(54) OVEN

(75) Inventors: Kyuoung Ho Kim, Suwon-si (KR); Yun Ic Hwang, Suwon-si (KR); Seok Weon Hong, Yongin-Si (KR); Pung Yeun Cho, Suwon-Si (KR); Yu Jeub Ha, Suwon-Si (KR); Sung Soo Park, Hwaseong-Si (KR); Sung Kwang Kim, Ansan-Si (KR); Kil Young Lee, Suwon-Si (KR); Cheol Jin Kim, Suwon-Si (KR); Tae Ho Kim, Hwaseong-Si (KR); Sang Hyun Kang, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1130 days.

(21) Appl. No.: 11/232,862

(22) Filed: Sep. 23, 2005

(65) Prior Publication Data

US 2006/0196495 A1 Sep. 7, 2006

(30) Foreign Application Priority Data

Mar. 2, 2005 (KR) ..... 10-2005-0017417

(51) Int. Cl.
*F24C 15/04* (2006.01)

(52) U.S. Cl. ..... 126/198; 126/273 R; 126/21 R

(58) Field of Classification Search ..... 126/198, 126/193, 273 R, 21 R, 21 A; 219/400
See application file for complete search history.

(56) References Cited

U.S. PATENT DOCUMENTS

| | | | | |
|---|---|---|---|---|
| 3,889,099 | A | 6/1975 | Nuss | |
| 5,387,258 | A * | 2/1995 | Puricelli | 126/21 A |
| 7,060,940 | B2 * | 6/2006 | Kim et al. | 219/400 |
| 2004/0159317 | A1 * | 8/2004 | Walther et al. | 126/198 |

* cited by examiner

*Primary Examiner*—Alfred Basichas
(74) *Attorney, Agent, or Firm*—Staas & Halsey LLP

(57) ABSTRACT

An oven, effectively and rapidly cooling a door by passing a sufficient quantity of cooling air through the door, is disclosed. The oven includes an outer case, an inner case, a door opening and closing the inner case, and a blower chamber having a cooling fan and provided at the upper side of the inner case. The door includes an inner plate and a frame to form an opened lower end. The frame has holes formed in the upper side to flowing air discharged by the cooling fan between the inner plate and an outer plate. A vent hole communicating with the blower chamber is provided in the upper end of the cooking chamber to pass hot air of the cooking chamber through the vent hole. Around the vent hole, a partition member is provided for preventing the hot air from being mixed with air discharged by cooling fan.

6 Claims, 6 Drawing Sheets

OVEN

CROSS-REFERENCE TO RELATED APPLICATIONS

This application claims the benefit of Korean Patent Application No. 2005-17417, filed on Mar. 2, 2005, in the Korean Intellectual Property Office, the disclosure of which is incorporated herein by reference.

BACKGROUND OF THE INVENTION

1. Field of the Invention

The present invention relates to an oven, and more particularly, to an oven for rapidly cooling a cooking chamber door.

2. Description of the Related Art

Generally, ovens are structured to heat a cooking chamber using electricity or gas to cook food placed in the cooking chamber. Since the cooking chamber of the oven is maintained at a high temperature when cooking food, a door for opening and closing the cooking chamber is also heated to a high temperature.

Thus, for safety, the oven should have a structure to cool the door under a prescribed temperature. For example, U.S. Pat. No. 3,889,099 discloses a structure to cool a door using a cooling fan installed in an oven when cooking food.

In the conventional oven, ambient air flows in the door by the cooling fan installed at the upper side of the conventional oven to cool the door when cooking food.

However, since the cooling fan, in the conventional oven, forces ambient air from an upper side to a lower side of the door through a nozzle, ambient air does not flow uniformly over the entire surface of the door. Thus, the door cannot be efficiently and rapidly cooled.

Moreover, since the conventional oven does not have a structure for separating hot air generated while cooking food in the cooking chamber from cooling air and discharging the hot air, it is difficult to devise a structure capable of reducing the door temperature.

SUMMARY OF THE INVENTION

Accordingly, an aspect of the invention is to provide an oven capable of effectively and rapidly cooling a cooking chamber door by causing a sufficient quantity of cooling air to flow through the cooking chamber door and preventing the cooling air from being mixed with hot air discharged from the oven.

Additional aspects and/or advantages of the invention will be set forth in part in the description which follows and, in part, will be apparent from the description, or may be learned by practice of the invention.

The foregoing aspects and advantages of the present invention are achieved by providing an oven including an outer case, an inner case disposed in the outer case and having at least one cooking chamber, a cooling fan installed at an upper side of the inner case to discharge air, and a door installed at a front side of the outer case to open and close the cooking chamber, the door including an inner plate, an outer plate, a frame to enclose upper sides and lateral sides of the inner plate and the outer plate, and a plurality of holes formed at an upper side of the frame to allow air discharged by the cooling fan to flow between the inner plate and the outer plate.

A blower chamber which is separated from the cooking chamber and is provided at the upper side of the inner case in which the cooling fan is disposed, and a vent hole communicated with the blower chamber is provided at an upper end of the cooking chamber such that hot air of the cooking chamber flows toward the blower chamber through the vent hole.

The blower chamber is integrally formed with a blowing guide upwardly extending from the bottom surface of the blower chamber such that air discharged by the cooling fan is guided toward the holes formed in the door.

The vent hole is disposed in the blower chamber without facing the holes of the door, and a partition member is installed around the vent hole to prevent the hot air discharged from the cooking chamber from being mixed with air discharged by the cooling fan.

The partition member includes a first partition plate disposed at an angle such that a rear end thereof is adjacent to a first side of the blowing guide and a front end thereof faces a second side of the blowing guide, and a second partition plate disposed such that a rear end thereof is connected with the first partition plate and a front end thereof faces the door, wherein the vent hole is surrounded by the first and second partition plates.

A gap is formed between the first side of the blowing guide and the first partition plate such that a small quantity of air discharged by the cooling fan is introduced through the gap and is mixed with the hot air discharged through the vent.

The inner case includes a separating wall for separating the inner case into an upper space and a lower space wherein a first cooking chamber is provided above the separating wall, a second cooking chamber is provided below the separating wall, and the vent hole is provided at the upper end of the first cooking chamber.

The oven further includes a guide pipe in which an end thereof is connected with an upper end of the second cooking chamber and another end is connected with the blowing guide such that hot air generated from the second cooking chamber is guided into the blowing guide.

Openings are formed in front opposite sides of the outer case to allow ambient air to be introduced between the outer case and the inner case, and at least one suction hole is formed at the upper side of the inner case to allow the ambient air to be introduced into the blower chamber.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
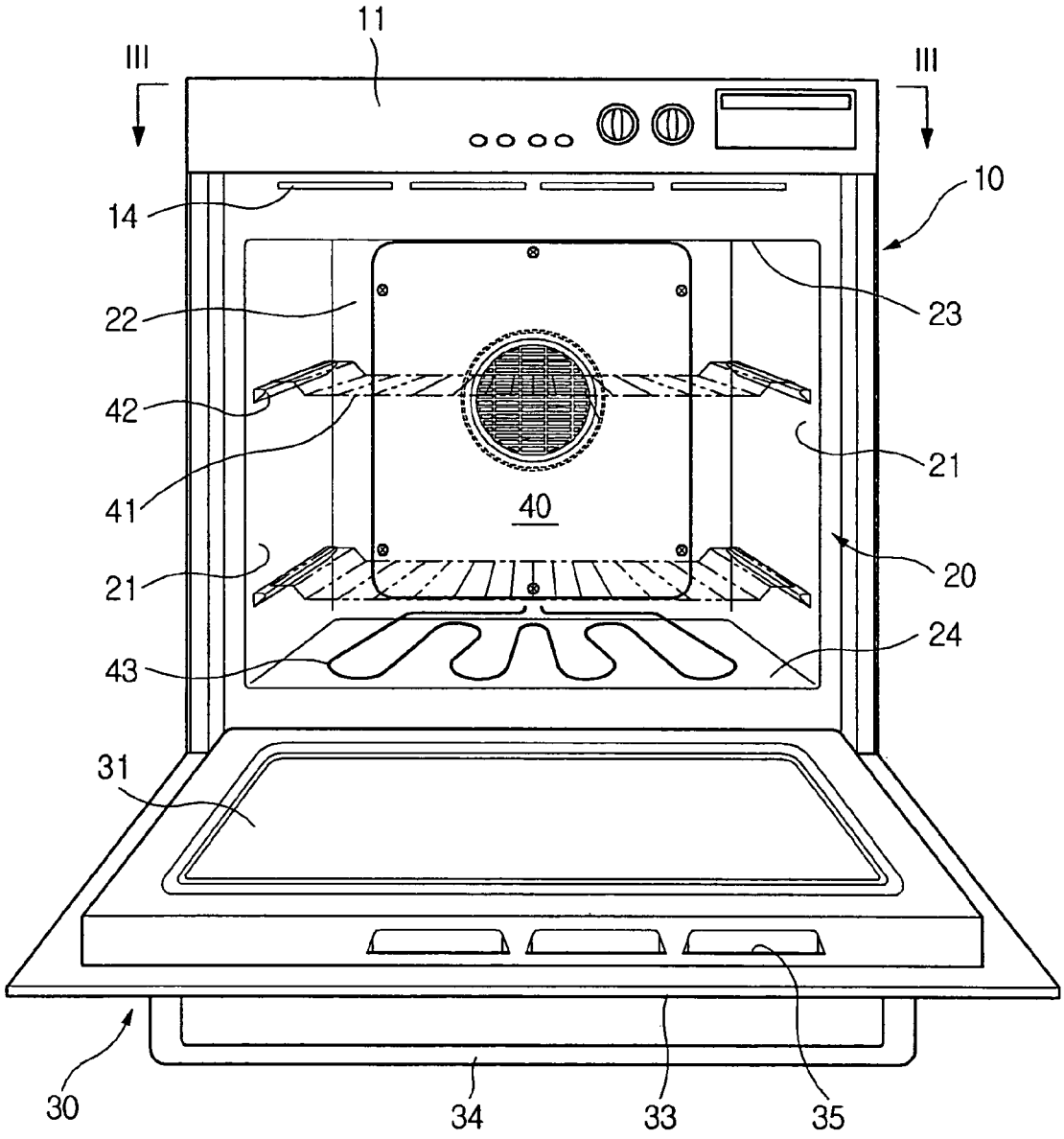
FIG. 1 is a front view of an oven according to a first embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

Figure 2:
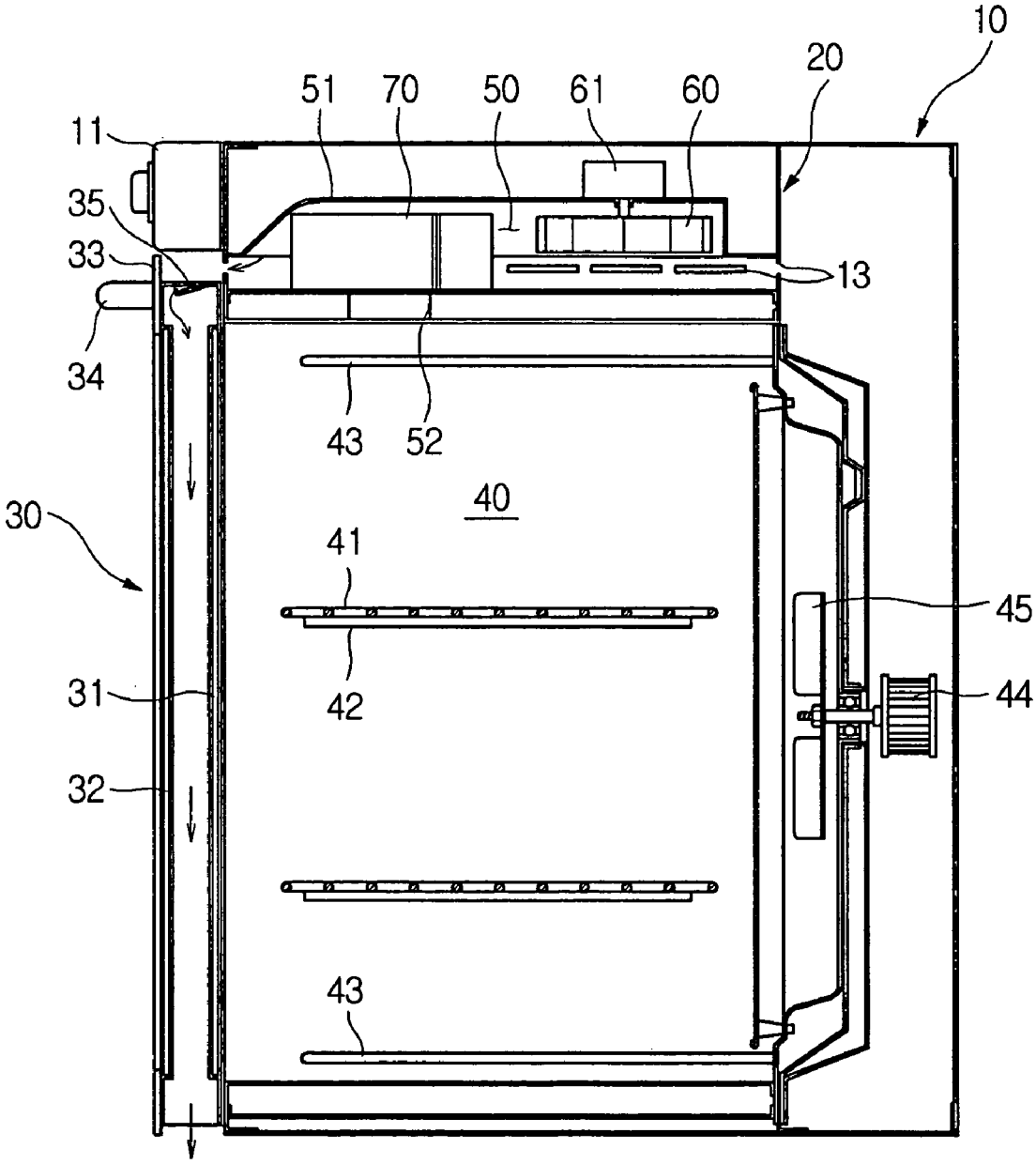
FIG. 2 is an elevation sectional view of the oven in FIG. 1.
Figure 3:
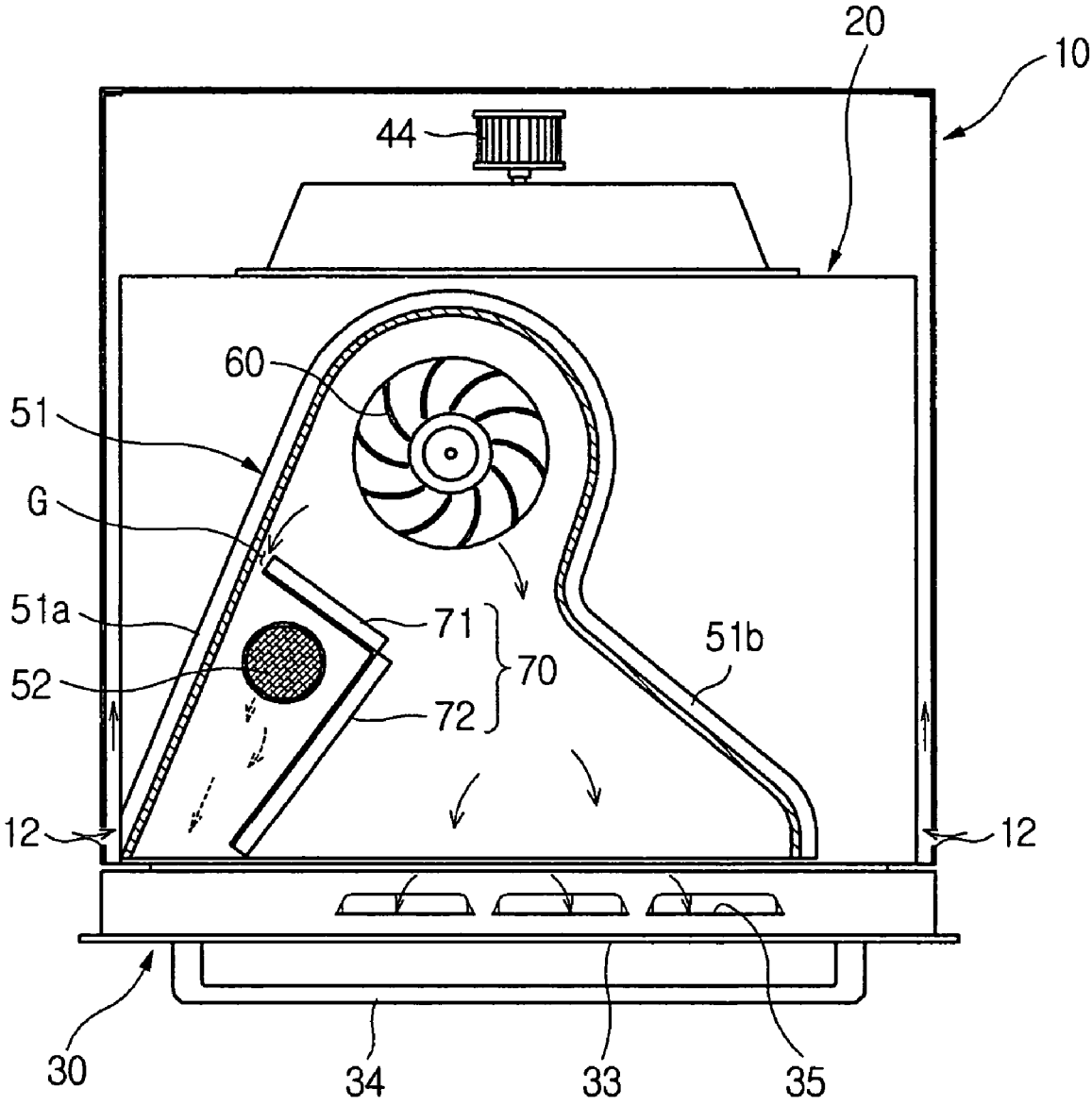
FIG. 3 is a sectional view taken along the line III-III in FIG. 1, illustrating separation and discharging of hot air, generated from a cooking chamber, from air for cooling a door.

FIGS. 1-3 are views illustrating an oven according to the first embodiment of the present invention, in which FIGS. 1 and 2 are a front view and a elevation sectional view of the oven according to the first embodiment of the present invention and FIG. 3 is a sectional view illustrating a discharge of hot air generated from a cooking chamber and separated from air for cooling a cooking chamber door.

As shown in FIGS. 1-3, the oven according to the first embodiment of the present invention comprises an open-front box-shaped outer case 10, an open-front box shaped inner case 20 accommodated in the outer case 10, and a door hinged to the lower side of the inner case 20 to open and close the open-front of the inner case, thereby forming an external appearance of the oven.

The inner case 20 comprises lateral sides 21, a rear side 22, a top side 23, and a bottom side 24, which are disposed in the outer case 10 and spaced apart from the outer case 10, to form a cooking chamber 40 where food to be cooked is placed. The outer case 10 includes various buttons and switches and a control panel 11, in which a display is installed, disposed at an upper side thereof, to allow a user to select cooking menu and cooking time and to control cooking procedure.

In the cooking chamber 40, a plurality of guide rails 42, for easily attaching and detaching racks 41, and a plurality of heaters 43, to supply heat to cook food on the racks 43, are installed. At an outer rear side of the cooking chamber 40, a fan motor 44 and a circulation fan 45 for circulating air in the cooking chamber 40 to make an inner temperature of the cooking chamber 40 uniform and to rapidly cook food, are installed.

The door 30 comprises a transparent inner plate 31 and a transparent outer plate 32 to allow the user to view the interior of the cooking chamber 40, a frame 33 coupled with the inner plate 31 and the outer plate 32 to form a space between the inner plate 31 and the outer plate 32 having a closed top, closed lateral sides, and an opened lower end, and a handle 34 couple with the frame 33 at an outer upper end of the door 30 to allow the door 30 to be conveniently opened and closed.

The upper side of the frame 33 is formed with a plurality of holes 35 to allow air discharged by a cooling fan 60 (shown in FIG. 3) to pass between the inner plate 31 and the outer plate 32 such that the inner plate 31, the outer plate 32 which is exposed to the user, and the frame 33 can be cooled at a closed state of the door 30 when cooking food in the cooking chamber 40.

A blower chamber 50 (shown in FIG. 2) is partitioned from the cooking chamber 40 at the upper side of the inner case 20 to blow cooling air to cool the door 30 such that the cooling fan 60 is disposed to extend from the interior to the rear side of the blower chamber 50. The cooling fan 60 is disposed at a peripheral side of the blower chamber 50 and is driven by being coupled with a fan motor 61.

Openings 12 are formed in a leading edge of the outer case 10 to allow ambient air to enter a space defined by the outer case 10 and the inner case 20. Suction holes 13 (shown in FIG. 2) are formed in lateral sides and rear side of the blower chamber 50, to allow the introduced air passed through the openings 12 to enter the blower chamber 50. A plurality of discharge holes 14 is formed at the upper side of the inner case 20 to communicate with the blower chamber 50.

Moreover, a blowing guide 51 extending upward and forming an air flow passage is integrally formed with the blower chamber 50 such that the air, introduced into the blower chamber 50 via the openings 12 and the suction holes 13 by the cooling fan 60, is guided to flow to a plurality of holes 35 formed in the door 30 through the discharge holes 14.

The cooking chamber 40 has a vent hole 52 formed at the top thereof to communicate with the blower chamber 50 such that hot air and gas, generated when cooking food in the cooking chamber 40, are discharged into the blower chamber 40 through the vent hole 52.

The vent hole 52 is disposed at a position of the cooking chamber 40 corresponding to a corner of the blowing guide 51, and the door 30 a hole 35 is not formed at a region facing the vent hole 52 such that hot air discharged from the vent hole 52 is directly discharged to the outside of the door 30 through the discharge holes 14 without entering the space between the inner plate 31 and the outer plate 32 of the door 30.

Moreover, a partition member 70 is further installed around the vent hole 52 such that hot air discharged from the vent hole 52 is discharged out of the door 30 without being mixed with the cooling air blown by the cooling fan 60.

The partition member 70 comprises a first partition plate 71 and a second partition plate 72, which are disposed at an angle. The first partition plate 71 is disposed at an angle such that a rear end thereof is adjacent to a first side 51*a* of the blowing guide 51 and a front end thereof faces a second side 51*b* of the blowing guide 51. The second partition plate 72 is disposed such that a rear end thereof is connected with the first partition plate 71 and a front end thereof faces the door 30.

A gap G is defined between the first partition plate 71 and the first side 51*a* of the blowing guide 51 such that a small quantity of air, flowing through the blowing guide 51 by a rotation of the cooling fan 60, is introduced to an interior of the partition member 70 through the gap G and is mixed with the hot air discharged through the vent hole 52, then is discharged after lowering the temperature of the hot air.

In the oven having the above-mentioned structure according to the first embodiment of the present invention, food is placed on the racks 41 disposed in the cooking chamber 40 and the door 30 is closed. When operating the heaters 43, the circulation fan 45, and the cooling fan 60, food is cooked by the heaters 43 and the circulation fan 45 and ambient air is introduced to the blower chamber 50 through the suction hole 13 by the cooling fan 60.

The ambient air introduced to the blower chamber 50 flows toward the door 30 along the blowing guide 51 and passes through the discharge holes 14. Continuously, the introduced ambient air cools the door 30 while passing through the space between the inner plate 31 and the outer plate 32 via the holes 35 formed in the frame 33 of the door 33.

Meanwhile, a small quantity of the ambient air flowing in the blowing guide 51 is introduced to the interior of the partition member 70 through the gap G, and simultaneously, hot air and gas, generated when cooking food in the cooking chamber 40, is discharged into the blower chamber 50 through the vent hole 52 and mixed with the small quantity of the ambient air introduced to the partition member 70 through the gap G, to lose a small degree of their temperature and be discharged out of the door 30.

As described above, the air introduced to the blower chamber 50 is not mixed with the hot air, discharged from the cooking chamber, due to the partition member 70 and the blowing guide 51, but is guided to flow downward along the inner space of the door 30, and the hot air, discharged from the cooking chamber 40, is mixed with a part of cooling air due to the partition member 70 to be discharged out of the door 30 at lowered temperature, so that the door 30 can be effectively and rapidly cooled.

Figure 4:
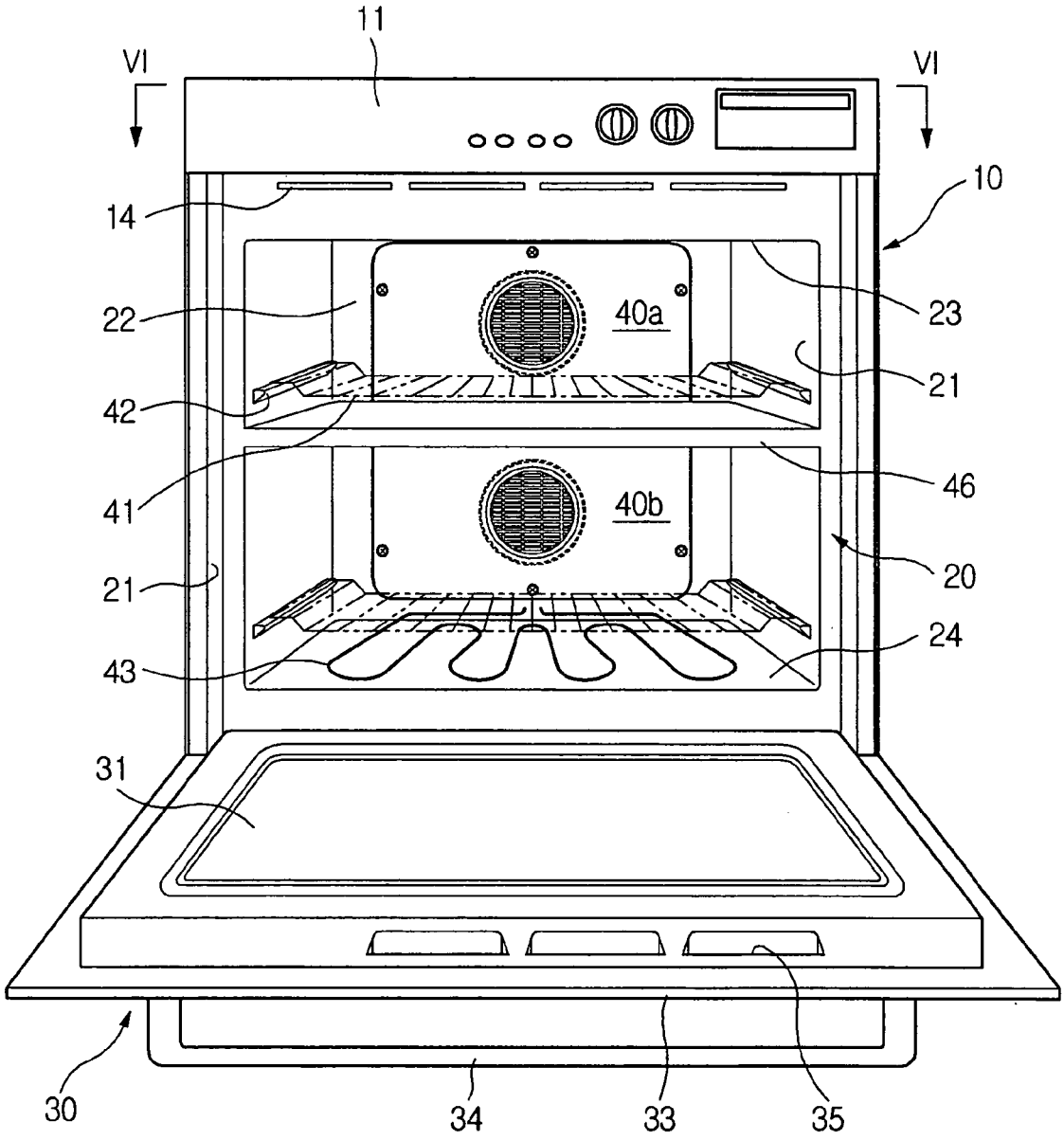
FIG. 4 is a front view of an oven according to a second embodiment of the present invention.
Figure 5:
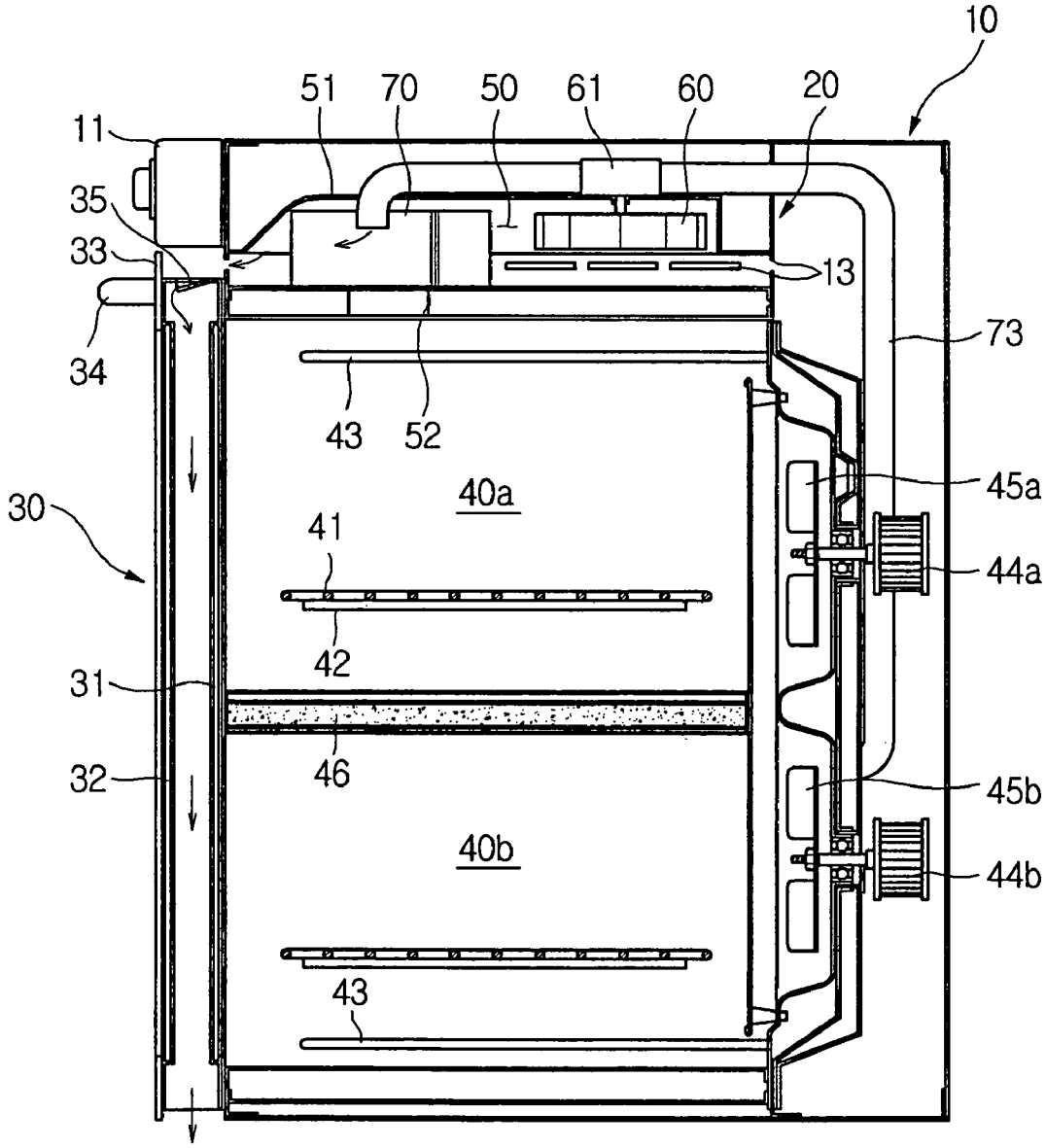
FIG. 5 is an elevation sectional view of the oven in FIG. 4.
Figure 6:
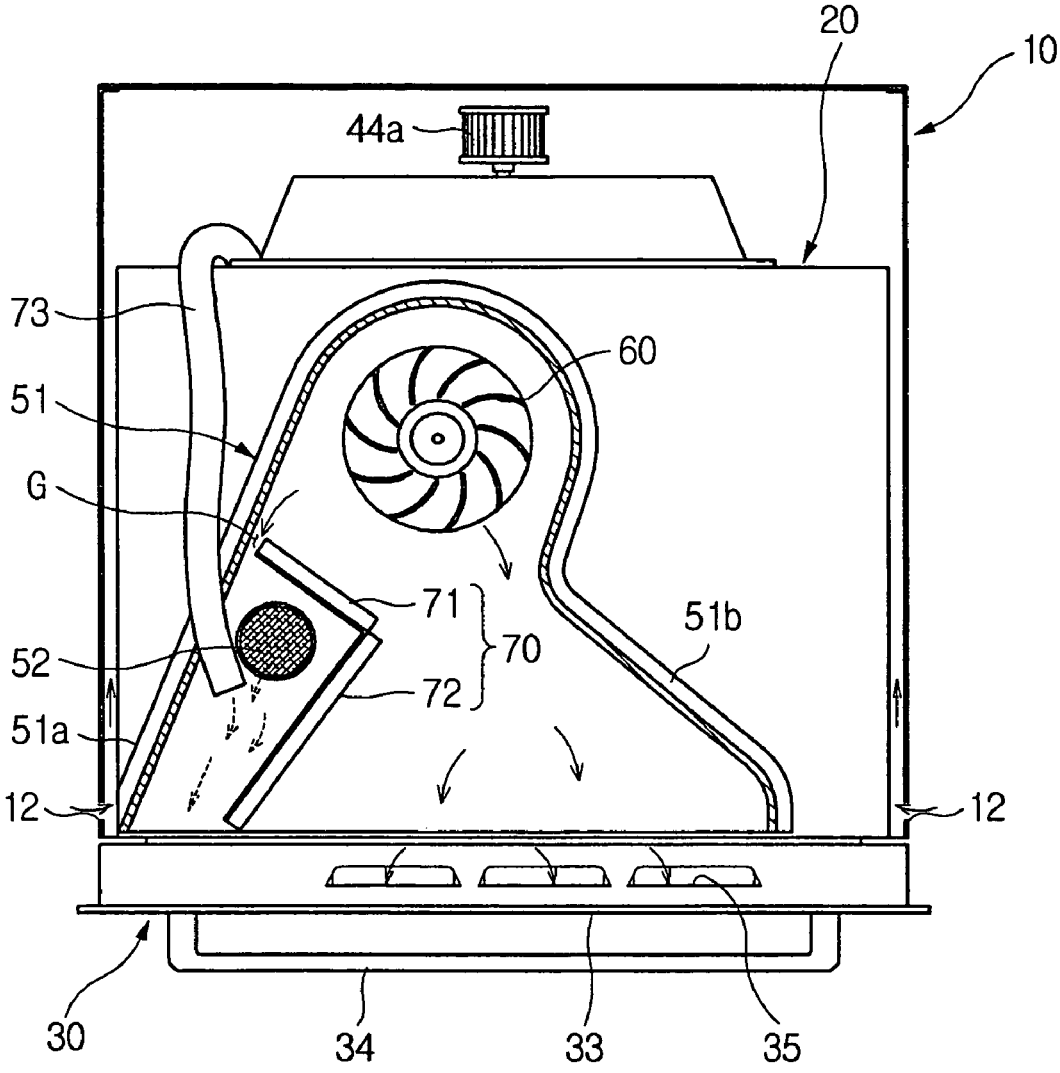
FIG. 6 is a sectional view taken along the line IV-IV in FIG. 4, illustrating separation and discharging of hot air, generated from upper and lower cooking chambers, from air for cooling a door.

FIGS. 4-6 illustrate an oven according to a second embodiment of the present invention. FIGS. 4 and 5 are a front view and an elevation view of an oven according to the second embodiment of the present invention, respectively, and FIG. 6 is a view illustrating separation and discharging of hot air, generated from upper and lower cooking chambers, from air for cooling a door.

As shown in FIGS. 4-6, the oven according to the second embodiment of the present invention has the same structure as the structure of the oven according to the first embodiment of the present invention as illustrated in FIGS. 1-3, except for the inner case 20 having an inner space divided into an upper space, i.e., a first cooking chamber 40*a* and a lower space, i.e., a second cooking chamber 40*b* separated by a separating wall 46, a first fan motor 44*a*, a first circulation fan 45*a*, a second fan motor 44*b*, and a second circulation fan 45*b*, which are respectively installed at the rear sides of the first and second cooking chambers 40*a* and 40*b*, and a guide pipe 73 for connecting the rear upper side of the second cooking chamber 40*b* to the blowing guide 51 to guide the hot air and gas, generated from the second cooking chamber 40*b*, toward the blowing guide 51.

An end of the guide pipe 73 connected to the blowing guide 51 is disposed in the partition member 70 where the vent hole 52 for venting the hot air and gas in the first cooking chamber 40*a* is located, so that hot air generated from the second cooking chamber 40*b* can be guided and discharged out of the door 30 by the partition member 70.

In the oven according to the second embodiment of the present invention, since the door 30 is cooled in the same way as in the oven according to the first embodiment of the present invention, the description of the oven according to the second embodiment will therefore be omitted.

As described above, the oven according to the present invention has a structure wherein cooling air blown by the cooling fan flows from the upper side to the lower side of the door, the entire door is rapidly and sufficiently cooled, guaranteeing safety in use of the oven.

Moreover, since the oven according to the present invention has a structure wherein hot air, discharged through the vent hole, is mixed with a small quantity of cooling air in the blower chamber due to the gap defined by the partition member, the hot air discharged from the cooking chamber is slightly reduced in temperature while being discharged from the oven. Thus, air for cooling the door is not mixed with the entire hot air, so that the door can be more effectively cooled.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An oven comprising:

an outer case;

an inner case disposed in the outer case and having at least one cooking chamber;

a blower chamber which is separated from the cooking chamber provided at an upper side of the inner case;

a cooling fan installed in the blower chamber;

a vent hole communicated with the blower chamber provided at the upper end of the cooking chamber such that hot air of the cooking chamber flows toward the blower chamber through the vent hole;

a door installed at the front side of the outer case to open and close the cooking chamber, the door comprising an inner plate, an outer plate, a frame to enclose the upper sides and the lateral sides of the inner plate and the outer plate, and a plurality of holes formed at an upper side of the frame to allow air discharged by the cooling fan to flow between the inner plate and the outer plate; and a blowing guide, the blower chamber being integrally formed with the blowing guide upwardly extending from a bottom surface of the blower chamber such that air discharged by the cooling fan is guided toward the holes formed in the door, the vent hole is disposed in the blower chamber without facing the holes of the door, and a partition member is installed around the vent hole to prevent the hot air discharged from the cooking chamber from being mixed with air discharged by the cooling fan.

2. The oven according to claim 1, wherein the partition member comprises:

a first partition plate disposed at an angle such that a rear end thereof is adjacent to a first side of the blowing guide and a front end thereof faces a second side of the blowing guide; and a second partition plate disposed such that a rear end thereof is connected with the first partition plate and a front end thereof faces the door;

wherein the vent hole is surrounded by the first and second partition plates.

3. The oven according to claim 2, wherein a gap is formed between the first side and the first partition plate such that a small quantity of air discharged by the cooling fan is introduced through the gap and is mixed with the hot air discharged through the vent.

4. The oven according to claim 3, wherein the inner case comprises a separating wall for separating the inner case into an upper space and a lower space wherein a first cooking chamber is provided above the separating wall, a second cooking chamber is provided below the separating wall, and the vent hole is provided at an upper end of the first cooking chamber.

5. The oven according to claim 4, further comprising a guide pipe in which an end thereof is connected with an upper end of the second cooking chamber and the other end is connected with the blowing guide such that hot air generated from the second cooking chamber is guided into the blowing guide.

6. The oven according to claim 1, wherein openings are formed in front opposite sides of the outer case to allow ambient air to be introduced between the outer case and the inner case, and at least one suction hole is formed at the upper side of the inner case to allow the ambient air to be introduced into the blower chamber.

* * * * *